US007117873B2

(12) United States Patent
Bachrach et al.

(10) Patent No.: US 7,117,873 B2
(45) Date of Patent: Oct. 10, 2006

(54) LICE AND NIT REMOVAL DEVICE

(75) Inventors: Frank Bachrach, Great Neck, NY (US); Steven Strauss, Hillsdale, NJ (US); Richard Roig, Sparta, NJ (US)

(73) Assignee: American Comb Corporation, Paterson, NJ (US)

( * ) Notice: Subject to any disclaimer, the term of this patent is extended or adjusted under 35 U.S.C. 154(b) by 442 days.

(21) Appl. No.: 10/658,643

(22) Filed: Sep. 9, 2003

(65) Prior Publication Data

US 2005/0051190 A1 Mar. 10, 2005

(51) Int. Cl.
*A45D 24/10* (2006.01)
*A45D 24/30* (2006.01)

(52) U.S. Cl. ..... 132/148; 132/129; 132/139; 132/157

(58) Field of Classification Search ..... 132/333, 132/138, 157, 216, 148, 129, 277, 139–142, 132/131–135, 137; 30/195; 15/402; 119/633, 119/625, 627
See application file for complete search history.

(56) References Cited

U.S. PATENT DOCUMENTS

| | | | | | |
|---|---|---|---|---|---|
| 595,470 | A | * | 12/1897 | Goldner | 30/233.5 |
| 881,890 | A | * | 3/1908 | Barr | 30/120 |
| 1,596,737 | A | * | 8/1926 | Watkins | 132/133 |
| 1,858,828 | A | * | 5/1932 | Immerheiser et al. | 106/460 |
| 2,272,580 | A | * | 2/1942 | Brooks | 30/195 |
| 2,532,921 | A | * | 12/1950 | Kashian | 30/233.5 |
| 3,603,323 | A | * | 9/1971 | Avella | 132/131 |
| 4,315,369 | A | * | 2/1982 | Borow | 30/257 |
| 4,612,944 | A | | 9/1986 | Bachrach et al. | 132/11 R |
| 4,612,945 | A | | 9/1986 | Bachrach | 132/137 |
| 4,648,401 | A | * | 3/1987 | Mattson | 606/174 |
| 4,807,652 | A | | 2/1989 | Bachrach | 132/137 |
| 4,819,670 | A | * | 4/1989 | Saferstein et al. | 132/156 |
| 5,153,997 | A | * | 10/1992 | Chiavaras et al. | 30/257 |
| 5,188,636 | A | * | 2/1993 | Fedotov | 606/144 |
| 5,232,000 | A | * | 8/1993 | Chiavaras et al. | 132/200 |
| D408,240 | S | | 4/1999 | Garcia | D8/57 |
| 6,006,758 | A | * | 12/1999 | Thorne | 132/139 |
| 6,079,107 | A | * | 6/2000 | Horvath | 30/233.5 |
| 6,932,825 | B1 | * | 8/2005 | Anderson | 606/147 |

* cited by examiner

*Primary Examiner*—Kevin Shaver
*Assistant Examiner*—Stephanie L. Willatt
(74) *Attorney, Agent, or Firm*—Kenneth Watov; Watov & Kipnes, P.C.

(57) ABSTRACT

A device for removing lice and nits from affected hair and scalp of an individual, has first and second movable blades, the first blade including a plurality of first saw teeth, the second blade including a plurality of second saw teeth, and means for movably retaining the first and second blades parallel and adjacent to one another with their respective first and second teeth in opposition and parallel planes along their respective longitudinal axes, whereby the blades can be selectively moved toward one another to cause their teeth to mesh together with hairs captively held therebetween, the first and second teeth being configured to thereafter provide via combing a scraping action against the entrapped hairs for removing lice and nits therefrom.

16 Claims, 6 Drawing Sheets

LICE AND NIT REMOVAL DEVICE

FIELD OF THE INVENTION

The present invention is related generally to products for personal grooming and hygiene, and more particularly to devices for removing lice and nits from the hair and scalp of an affected individual.

BACKGROUND OF THE INVENTION

Head lice (*Pediculus humanus capitis*) are small parasitic insects, which have evolved to live and thrive on the scalp and neck hairs of their human host. The external parasitic insects are often difficult to eradicate, especially in poverty stricken areas, and present a health problem to those afflicted. Head lice can also afflict people in developed areas such as in schools where people are in constant close contact. Those afflicted with head lice have to undergo some form of treatment or intervention for relief. One form of intervention uses insecticides or pesticides, which have been generally found to be effective and safe, if handled properly. The insecticide or pesticide is usually periodically applied to the hair and scalp of the afflicted individual to kill the head lice. Recently, it has been found that certain head lice strains have developed resistance against some of the more popular insecticides or pesticides currently available in the market.

In addition to insecticides or pesticides, mechanical means have also been employed in the treatment of head lice. Such mechanical means function by physically removing head lice and nits from the hair and scalp and can be effectively implemented alone or in combination with the insecticide or pesticide treatment. One mechanical means found to be effective is the lice and nit comb, which is a toothed instrument adapted for confining hair and sifting out the lice and nits. The typical lice and nit comb includes a plurality of spaced apart teeth arranged in a single row. The space between adjacent teeth is typically diminutive to permit the strands of hair to pass through as the comb is drawn, but prevent head lice and nits from passing through the space. In this manner, lice and nits present on the hair strands are effectively scraped off as the comb moves along the length of the hair.

Ideally, in order to ensure that the lice and nits are caught by the comb, the entire outer surface of the hair strands are scraped and cleaned to prevent the lice and nits from avoiding the scraping action. However, the adjacent parallel teeth of the lice and nit comb forms open ended portions which are not able to scrape certain portions of the hair strands occupied therebetween. In addition, the teeth of the lice and nit comb are fixed and stationary which does not permit adjustment in response to variations in hair strand thickness and density of the hair combed, thus further diminishing lice and nit removal. These limitations have made prior art lice and nit combs more time consuming and inconvenient to use, less effective in sifting and removing lice and nits from hair, and diminished in their ability to accommodate all hair types, thickness and volume.

Accordingly, there is a need for a lice and nit removal device capable of captively and circumferentially grasping around strands of hair for enhanced scraping and cleaning action to entrap and remove lice and nits present as the device is drawn along the length of the grasped hair. In this manner, any lice and/or nit present in the hair is efficiently and effectively sifted and removed therefrom. There is a further need for a lice and nit removal device designed to accommodate various hair types, thickness, volume and curliness.

SUMMARY OF THE INVENTION

The present invention is directed to a lice and nit removal device which can be assembled and operated in a simple and effective manner. The lice and nit removal device is designed to provide the user with a grasping action around which a portion of the affected hair is grasped through scissor vise-like operation. The lice and nit removal device is constructed to totally encompass the grasped portions of the hair strands to enhance scraping and cleaning contact for improved sifting and removal of lice and nits. The lice and nit removal device of the present invention includes a pair of parallel and closely opposing blade members each having opposed saw toothed edge portions that can move toward and overlap one another to form size adjustable apertures. These apertures can be adjusted by moving the blade members to conform to the diameter of the hair strands for achieving closer tolerances and enhanced surrounding contact therearound. The device of the present invention is further configured to allow the opposed edge portions to join in a substantially parallel arrangement.

As briefly noted above, the opposed saw toothed edge portions are adapted to form, in combination, a series of adjustable apertures disposed along the common length thereof. The size of the apertures can be diametrically varied, by moving the blade members toward or away from one another. The apertures are designed to captively retain and surround the surface of the grasped hair and to prevent passage of the lice or nit therethrough. The variable apertures in the lice and nit removal device further allows hair of varying degree of thickness, curliness, volume and density to be readily accommodated without diminishing its lice and nit removal capability. These features of the present invention significantly enhance overall ease of use and effectiveness. The relative simplicity and cost effective manner in which the device can be fabricated and implemented make them especially suitable for retail consumer use.

In one aspect of the present invention, there is provided a device for removing lice and nits from the affected hair and scalp of an individual, comprising:

first and second blade members, each having opposed saw toothed edge portions, in combination, configured to form a plurality of diametrically variable apertures along the length thereof; and means for movably retaining the first and second blade members parallel and adjacent to one another with their respective saw toothed opposed edge portions both in opposition and parallel planes along their respective longitudinal axes, whereby the first and second blade members can be selectively moved toward one another with respective teeth overlapping to form the apertures with hairs captively and circumferentially held therebetween, the plurality of apertures being configured to thereafter provide via combing a scraping action against the entrapped hairs for removing lice and nits therefrom.

In a particular aspect of the present invention, there is provided a device for removing lice and nits from the affected hair and scalp of an individual, comprising:

first and second movable blades;

the first blade including a plurality of first saw teeth;

the second blade including a plurality of second saw teeth; and means for movably retaining the first and second blades parallel and adjacent to one another with their respective first and second teeth both in opposition and parallel planes along their respective longitudinal axes, whereby the blades can be selectively moved toward one another to cause their teeth to mesh together with hairs captively held therebetween, the first and second teeth being configured to thereafter provide via combing a scraping action against the entrapped hairs for removing lice and nits therefrom.

BRIEF DESCRIPTION OF THE DRAWINGS

Various embodiments of the invention are described in detail below with reference to the drawings, in which like items are identified by the same reference designation, wherein.

DETAILED DESCRIPTION OF THE INVENTION

Figure 1:
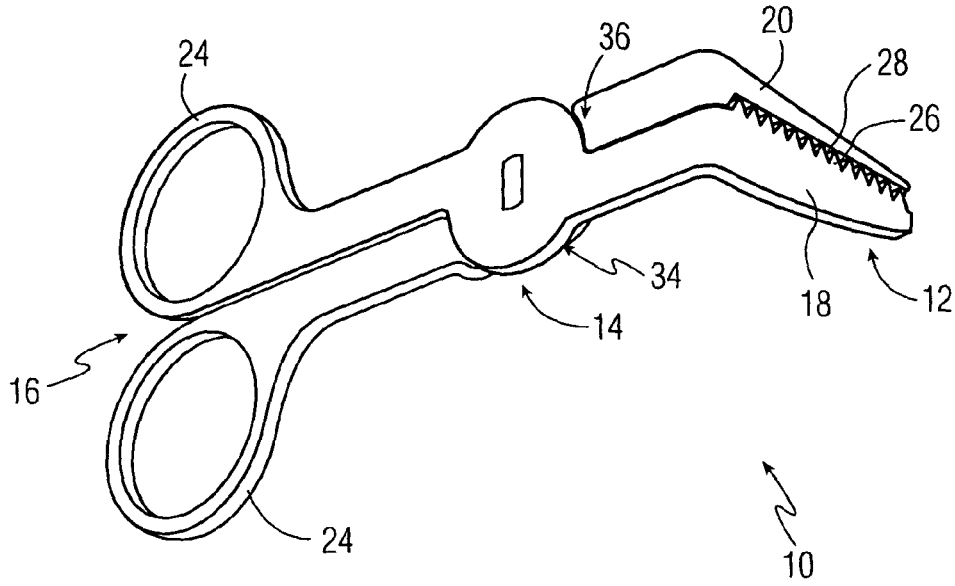
FIG. 1 is a perspective view looking from the bottom toward a lice and nit removal device in a closed position for one embodiment of the present invention.

The present invention is directed to a device for removing lice and nits present in the hair and/or on the scalp of a warm-blooded animal including humans. The lice and nit device is designed to be operated though scissor vise-like action. The lice and nit removal device of the present invention is further designed to allow a circumferential portion of the hair to be completely enclosed and contacted for achieving tighter tolerance between the device and the surface of the hair strands. As the device is drawn along the length of the hair, the lice and nits are more efficiently and effectively captured and removed, thus reducing the number of passes required to treat the section of the hair. The lice and nit removal device of the present invention includes a plurality of variably sized apertures which can be adjusted to provide tighter clearance with the hair captively retained therein, thus allowing various hair types, thickness, volume and curliness to be readily accommodated.

Generally, the lice and nit removal device of the present invention includes first and second opposed members, each having opposed saw toothed edge portions, in combination, configured to form, upon partial parallel overlapping or intermeshing of the teeth, a plurality of diametrically variable apertures along the length thereof, and means for movably retaining the first and second blade members parallel and adjacent to one another with their respective opposed saw toothed edge portions in parallel planes along their respective longitudinal axes, whereby the first and second blade members can be selectively moved toward or away from one another to adjustably form the apertures with hairs captively and circumferentially held therebetween, the plurality of apertures being configured to thereafter provide via combing a scraping and sifting action against the entrapped hairs for removing lice and nits therefrom.

Referring to FIGS. 1 to 4, a lice and nit removal device identified generally by the reference numeral 10 is shown in one embodiment of the present invention. The device 10 includes a tip portion 12, a pivot portion 14, and a handle portion 16. The tip portion 12 of the device 10 includes a first blade member 18 and an offset opposing second blade member 20. The first and second blades 18 and 20, respectively, are adapted to be selectively moved about the pivot portion 14 from a closed position to an opened position (as shown best in FIGS. 1 and 2, respectively). The device 10 can be fabricated from any suitable durable material including, but not limited to, metal, plastic, and the like. In a preferred embodiment, the device 10 is formed from a plastic polymer such as, for example, acrylonitrile butadiene styrene (ABS).

The first and second blade members 18 and 20 of the tip portion 12 are oriented at an angle, preferably 90° from the pivot portion 14 and the handle portion 16. This ensures that the first and second blade members 18 and 20 are maintained substantially parallel to one another as the device 10 goes from an open to the closed position. In this manner, the blade members 18 and 20 move toward one another and are able to mate flush with one another around the grasped portion of the hair, thus allowing the blade members 18 and 20 to move fully to the closed position. Furthermore, the bent first and second blade members 18 and 20 of the tip portion 12 allow the user to hold the device 10 in an ergonomically acceptable position during use.

The pivot portion 14 includes a pivot 22 for permitting movement of the first and second blade members 18 and 20 between the open and closed positions. The device is composed of an upper component 34 and a lower component 36 which are attached to one another at the pivot 22 as will be further described hereinafter. The handle portion 16 includes a pair of finger grips 24 which are held by the user to manipulate the device 10 into the open and closed positions. The user holding the device 10 similarly to holding a pair of scissors, can move the first and second blade members 18 and 30 to the open position by moving the finger grips 24 apart or move them to the closed position by moving the finger grips 24 together.

In a preferred embodiment, the first and second blade members 18 and 20 each include a saw-tooth edge portion 26 or 28, respectively, in this example. However, the present invention is not meant to be limited to the use of the saw-tooth shaped teeth, and can include other shapes for the teeth and junctions or spaces therebetween such as, for example, triangular, rectangular, quadrilateral, trapezoidal, pentagonal, hexagonal, circular, elliptical and the like. In one example, the teeth can each be rectangle-shaped with rectangular junctions or gaps spaced therebetween. The saw-tooth edge portions 26 and 28 are configured to interact with one another to grasp a portion of the hair stands therebetween with the first and second blade members 18 and 20 in the closed position. The saw-tooth edge portions 26 and 28 in combination form a series of apertures that can be varied in size to receive the hair strands for combing as will be further described hereinafter. As the device 10 is drawn along the length of the grasped hair, the saw-tooth edge portions 26 and 28 provide sufficient clearance to allow the hair to pass therethrough while capturing any lice or nits present thereon as will be further described hereinafter.

Figure 2:
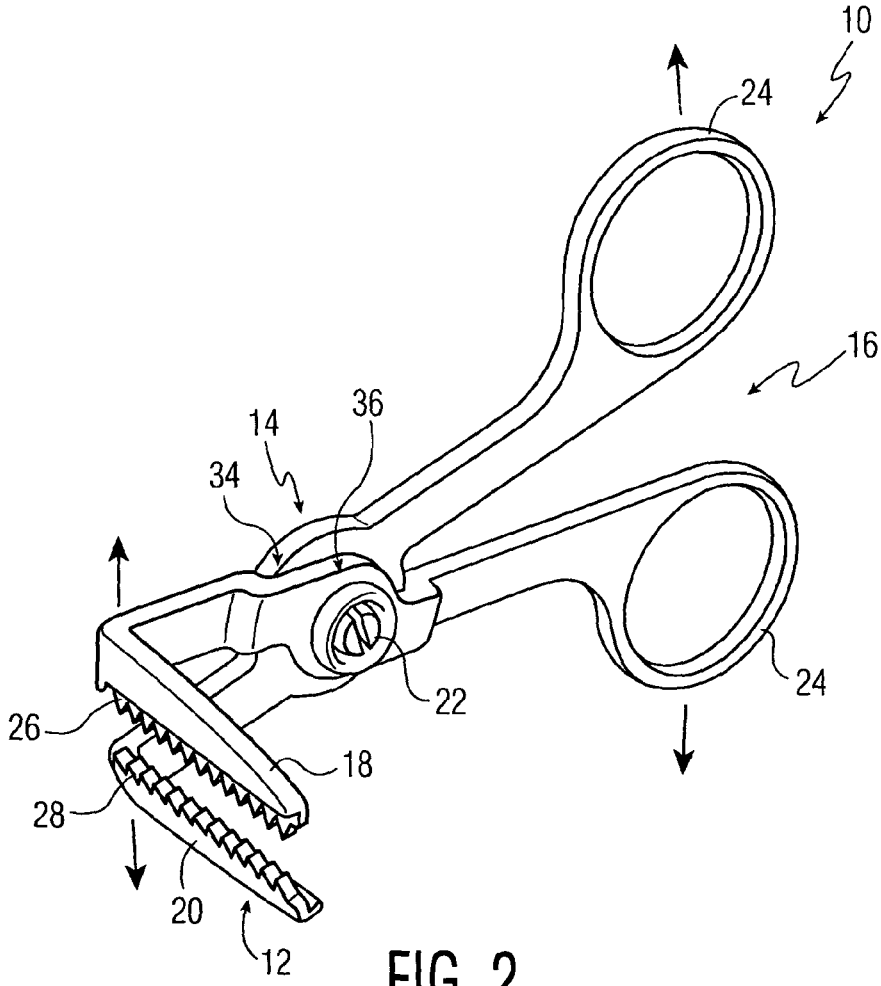
FIG. 2 is a perspective view of the lice and nit removal device of FIG. 1 rotated 90° clockwise and in an open position in accordance with one embodiment of the present invention.
Figure 3:
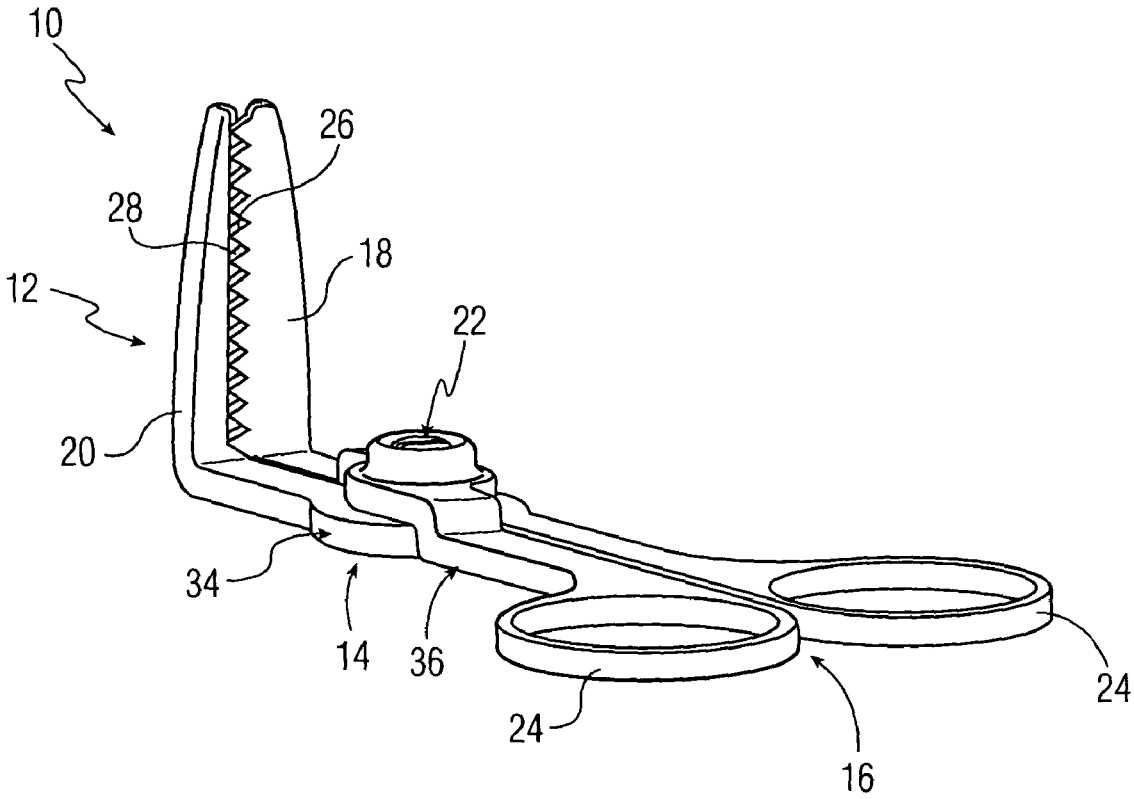
FIG. 3 is a rear perspective view looking toward the bottom of the lice and nit removal device in accordance with one embodiment of the present invention.
Figure 4:
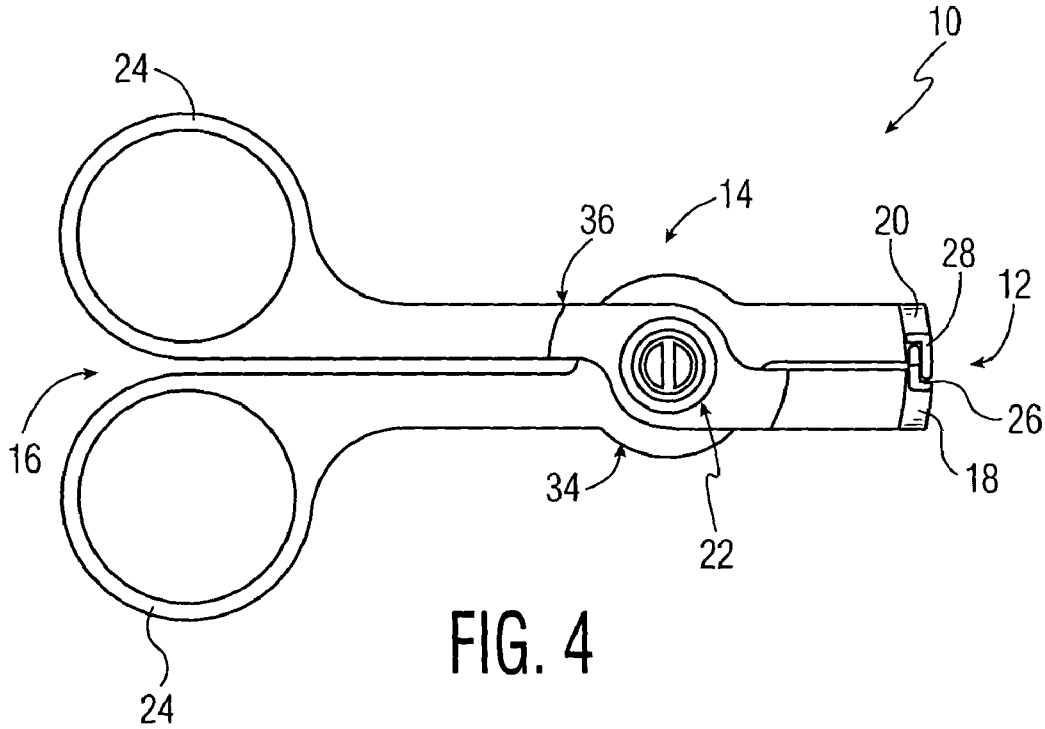
FIG. 4 is a bottom plan view of the lice and nit removal device in accordance with one embodiment of the present invention.

With specific reference to FIGS. 2 and 4, the configuration of the edge portions 26 and 28 are best shown therein. The saw-tooth edge portion 26 of the first blade member 18 is offset or stepped from the saw-tooth edge portion 28 of the second blade member 20 yielding an overlapping arrangement therebetween, as shown, when the blade members 18 and 20 are moved toward a closed position. The saw-tooth edge portions 26 and 28 are thus positioned parallel in different planes to one another. This arrangement permits the saw-tooth edge portions 26 and 28 to slide past one another as they are moved into a closed position.

Figure 5A:
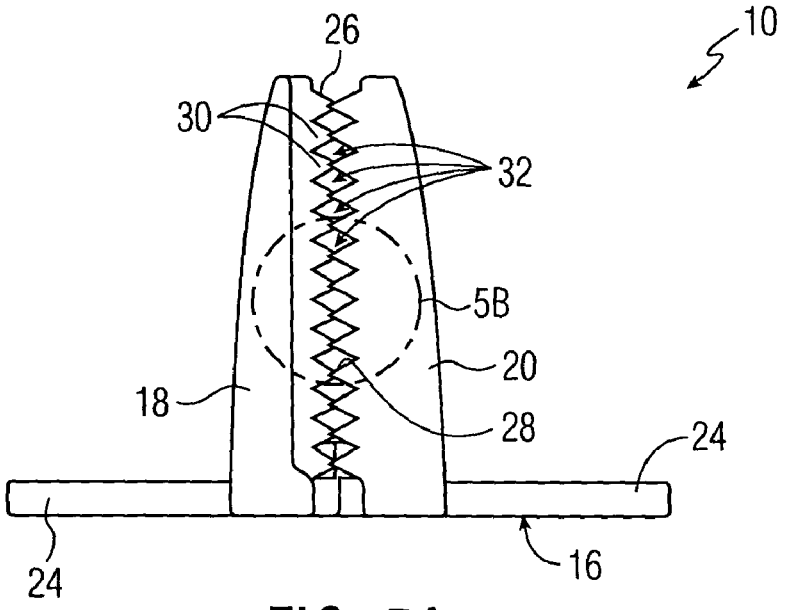
FIG. 5A is a front elevational view of the lice and nit removal device in a partially open position in accordance with one embodiment of the present invention.
Figure 5B:
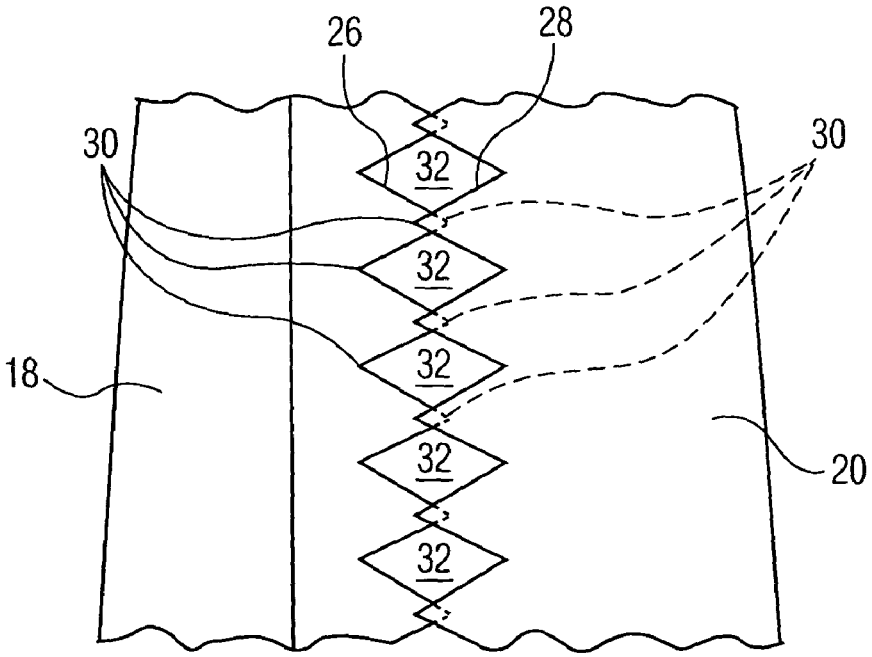
FIG. 5B is an exploded detailed view of the lice and nit removal device at the portion 5B of FIG. 5A showing the diamond shaped apertures in accordance with one embodiment of the present invention.

Referring to FIGS. 5A and 5B, a front elevational view of the device 10 is shown with the first and second blade member portions 18 and 20 in a partially open position. Each of the saw-tooth edge portions 26 and 28 include a plurality of saw tooth points 30 extending therefrom toward one another, but in different and closely adjacent parallel planes. As shown better in FIG. 5B, as the blade members 18 and 20 move from the open position toward the closed position, the pairs of offset parallel saw tooth points 30 in combination form a plurality of diamond shaped apertures 32 which enlarge or reduce in size by the movement of the first and second blade members 18 and 20 toward or away from one another, respectively. In this manner, the pairs of offset and opposing saw tooth points 30 are positioned to fully encircle the strands of hair. The offset configuration of the first and second blade members 18 and 20 allow the saw tooth points to slide past one another, thus allowing the apertures to reduce in size as required to completely match the diameter of the hair strands captively retained therein.

In a preferred embodiment of the present invention, the first and second blade members 18 and 20, are each formed from a single piece of material with their associated upper and lower components 34 and 36, respectively. However, they can be made from separate pieces of material which must then be bonded or otherwise secured together.

Figure 6:
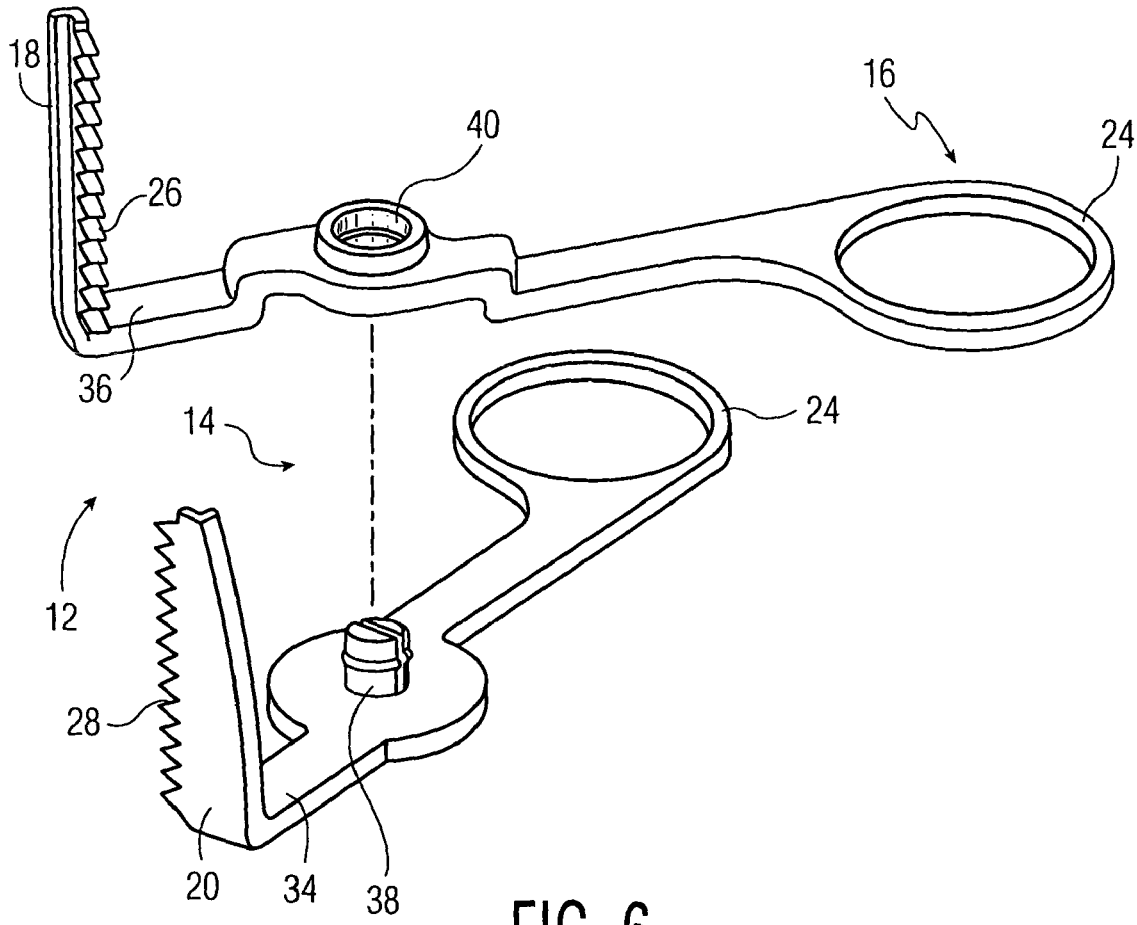
FIG. 6 is an exploded assembly view of the lice and nit removal device in accordance with one embodiment of the present invention.

Referring to FIG. 6, an exploded assembly view of the device 10 is depicted to illustrate the construction of the device 10. The device 10 is formed generally from an upper component 34 and a lower component 36. The upper component 34 includes a spindle 38 extending away from a middle portion thereof. The lower component 36 includes a hole 40 extending therethough for receiving and retaining therein the spindle 38 of the upper component to form the pivot 22 as will be described hereinafter. The spindle 38 is captively retained within the hole 40 for enabling pivotal engagement therebetween.

Figure 7A:
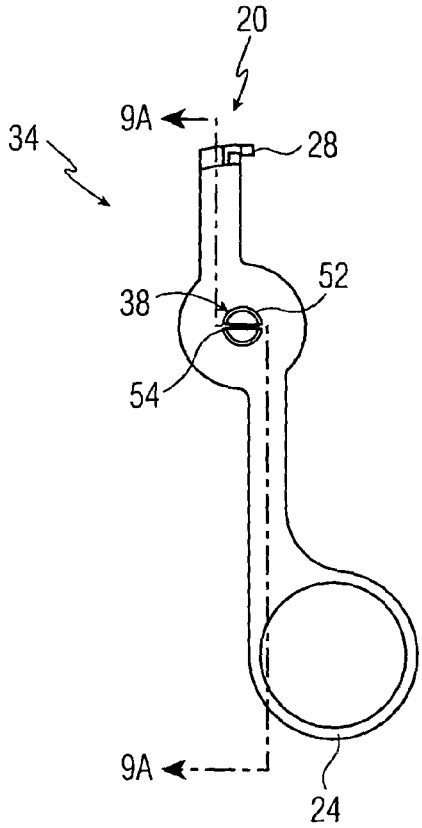
FIG. 7A is a bottom plan view of an upper component forming part of the lice and nit removal device in accordance with one embodiment of the present invention.
Figure 7B:
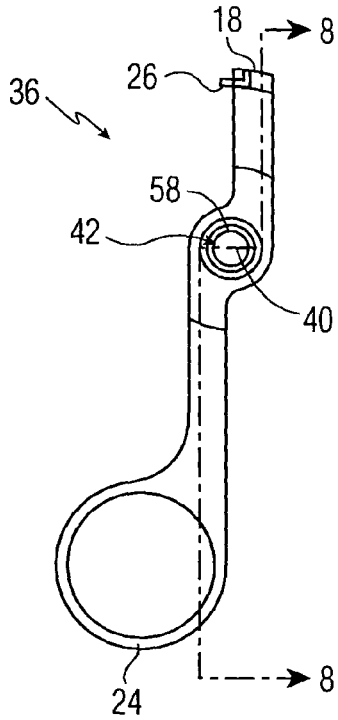
FIG. 7B is a bottom plan view of a lower component forming part of the lice and nit removal device in accordance with one embodiment of the present invention.

With reference to FIGS. 7A and 7B, bottom plan views of the upper component 34, and the lower component 36 are shown, respectively.

Figure 8:
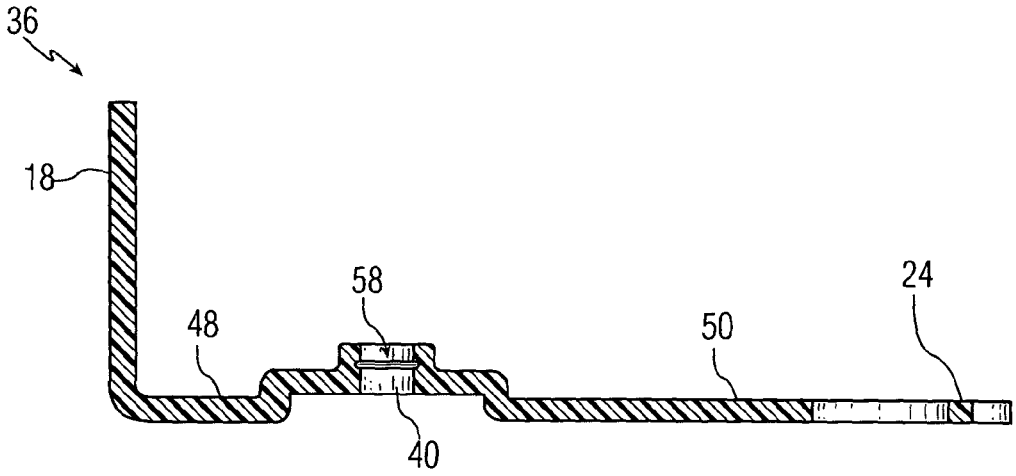
FIG. 8 is a side cross sectional view of the lower component along the cross section line 8—8 of FIG. 7B in accordance with one embodiment of the present invention.

With reference to FIG. 8, a side cross sectional view of the lower component 36 is shown to illustrate the configuration of the hole 40. The hole 40 includes an annular groove 58 extending along the inside surface thereof. The annular groove 58 is adapted to receive and engage the spindle 38 to maintain secure retainment as will be described hereinafter.

Figure 9A:
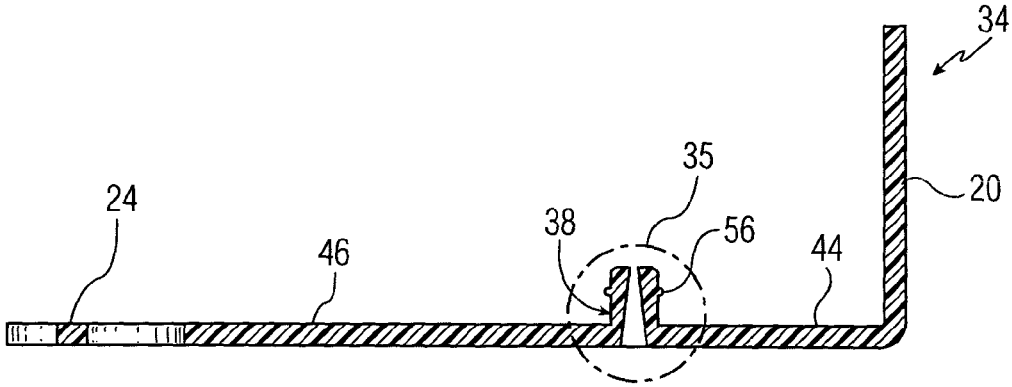
FIG. 9A is a side cross sectional view of the upper component the cross section line 9A—9A of FIG. 7A in accordance with one embodiment of the present invention.
Figure 9B:
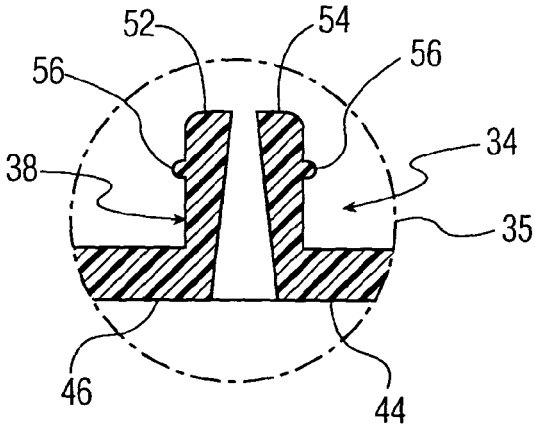
FIG. 9B is an exploded cross sectional view of a portion 35 of the upper component of FIG. 9A in accordance with one embodiment of the present invention.

Referring to FIG. 9A, a side cross sectional view of the upper component 34 is shown to illustrate the configuration of the spindle 38. As shown best in FIG. 9B, a exploded detailed view of the portion identified within the circle 35 of FIG. 9A is depicted. The spindle 38 includes two hemispheric studs 52 and 54, and a ledge portion 56 extending from the hemispheric studs 52 and 54. As the spindle 38 is inserted into the hole 40 of the lower component 36, the hemispheric studs 52 and 54 are biased inward. As the ledge portion 56 reaches the annular groove 58 and becomes seated therein, the studs 52 and 54 spring back outwardly. The ledge portion 56 of the spindle 38 and the annular groove 58 of the hole 40 cooperate to prevent the spindle 38 from being retracted therefrom, thereby providing a secure attachment therebetween. The ledge portion 56 is able to journey within the annular groove 58, thus allowing the spindle 38 to rotate about within the hole 40 to provide pivotal movement between the upper and lower components 34 and 36.

Although various embodiments of the invention have been shown and described, they are not meant to be limiting. Those of skill in the art may recognize various modifications to these embodiments, which modifications are meant to be covered by the spirit and scope of the appended claims. For example, in another embodiment of the present invention, the blade members 18 and 26 are not bent away from their associated upper and lower components 34 and 36, respectively, but a cam mechanism must be added to ensure that the blade members 18 and 26 have their respective teeth in opposition and parallel at all times.

What is claimed is:

1. A device for removing lice and nits from the affected hair and scalp of an individual, comprising:

first and second blade members, each having longitudinal opposed edge portions, each edge having successive uniformly shaped teeth; and means for movably retaining said first and second blade members to move their respective teeth parallel and adjacent to one another with their respective opposed edge portions in offset parallel planes along their respective longitudinal axes, and with opposed side faces in close proximity, whereby the teeth of said first and second blade members are selectively moved in parallel toward one another, with portions of the affected hairs therebetween, to form apertures of a shape to completely surround entrapped hairs held therebetween, the size of said apertures being controlled by the extent of closure between said first and second blade members, said plurality of apertures further being configured to thereafter provide via combing movement of said first and second blades a scraping action by edges of said teeth against individual entrapped hairs for removing lice and nits therefrom.

2. The device of claim 1, wherein the apertures are each diamond-shaped.

3. The device of claim 2, wherein the teeth of said first and second blade members are saw-tooth shaped.

4. The device of claim 1, wherein the movably retaining means further comprises:

a first elongate element extending away from the first blade member;

a second elongate element extending away from the second blade member; and a pivot connecting an intermediate portion of the first elongate member to an intermediate portion of the second elongate member to provide scissor vise-like movement.

5. The device of claim 4, wherein the first and second blade members are oriented at an angle to the first and second elongate elements, respectively.

6. The device of claim 5, wherein the angle is 90°.

7. The device of claim 1, whereby their respective teeth overlap when the first and second blade members are moved toward one another for providing a plurality of said apertures therebetween.

8. The device of claim 1, wherein the teeth of said first and second blade members are saw-tooth shaped.

9. The device of claim 1, wherein said first and second blade members each consist of a single piece of plastic material.

10. The device of claim 1, wherein said first and second blade members each consist of a single piece of material.

11. A device for removing lice and nits from affected hair and scalp of an individual, comprising:

first and second movable blade members;

said first blade member including a plurality of first saw teeth;

said second blade member including a plurality of second saw teeth; and means for movably retaining said first and second blade members parallel and adjacent to one another with their respective first and second teeth in opposition and offset parallel planes along their respective longitudinal axes, and with opposed side faces in close proximity, whereby said blade members can be selectively moved in parallel toward one another, with hairs therebetween, to cause their teeth to closely overlap with hairs captively held and completely entrapped in capture regions formed therebetween, the size of said capture regions being controlled by the extent of closure between said first and second blade members, said first and second teeth being configured to thereafter provide via combing action a scraping action by edges of said teeth against individual entrapped hairs for removing lice and nits therefrom.

12. The device of claim 11, wherein the apexes of the first saw teeth are arranged with opposing apexes of the second saw teeth in offset planes from one another, whereby said capture regions are diamond shaped.

13. The device of claim 11, wherein the movably retaining means further comprises:

a first elongate element extending away from the first blade member;

a second elongate element extending away from the second blade member; and a pivot connecting an intermediate portion of the first elongate member to an intermediate portion of the second elongate member to provide scissor vise-like movement.

14. The device of claim 13, wherein the first and second blade members are oriented at an angle to the first and second elongate elements, respectively.

15. The device of claim 14, wherein the angle is 90°.

16. The device of claim 11, wherein the capture regions are each diamond-shaped.

* * * * *